United States Patent [19]

Connolly et al.

[11] Patent Number: 4,946,057

[45] Date of Patent: Aug. 7, 1990

[54] STORAGE BOX WITH LOCKING LID AND WALL MOUNTING APPARATUS

[76] Inventors: Brian D. Connolly, 7 King Henry Ct., Merrimack, N.H. 03054; Michael J. Osbourne, 153 Barrett Hill Rd., Hudson, N.H. 03051

[21] Appl. No.: 309,822

[22] Filed: Feb. 13, 1989

[51] Int. Cl.[5] ..... B65D 25/22; B65D 43/12

[52] U.S. Cl. ..... 220/481; 220/347; 206/45.28

[58] Field of Search ..... 220/18, 345, 346, 347, 220/348, 350; 206/1.5, 45.12, 45.28

[56] References Cited

U.S. PATENT DOCUMENTS

| | | | |
|---|---|---|---|
| 1,192,767 | 7/1916 | Dyer | 220/346 |
| 1,740,327 | 12/1929 | Baker | 206/45.28 |
| 2,083,356 | 6/1937 | Batdorf | 220/351 |
| 2,093,508 | 9/1937 | Batdorf | 220/351 |
| 2,929,530 | 3/1960 | Sargent | 220/345 |
| 3,782,584 | 1/1974 | Swenson | 220/346 |
| 3,832,498 | 4/1958 | Parsons | 220/18 |
| 4,126,224 | 11/1978 | Laauwe | 206/1.5 |

FOREIGN PATENT DOCUMENTS

| | | | |
|---|---|---|---|
| 409207 | 9/1934 | United Kingdom | 217/62 |
| 662661 | 12/1951 | United Kingdom | 217/62 |

*Primary Examiner*—George E. Lowrance
*Attorney, Agent, or Firm*—Jospeh E. Funk

[57] ABSTRACT

A storage container with locking lid and wall mounting arrangement for multiple containers is disclosed. The top left and right edges of the container have first extensions substantially along their length and an arctuate extension on each of them. The left and right rear vertical edges of the container have second extensions. A lid has rolled edges on its left and right sides and there is a hole through each of the rolled edges. As the lid is attached to the box by sliding its rolled edges over the first extensions, the arctuate extensions slightly deform the rolled edges until the box is fully closed and the arctuate extensions then enter the holes to lock the lid to the container. When the lid is removed from the container it is attached to its rear by sliding the rolled edges of the lid over the second extensions. The wall mounting arrangement has a small ledge below opposed rolled edges, and the container is attached to the mounting arrangement by sliding the second extensions on the rear of the container downward into the opposed rolled edges until the bottom of the container sits on the ledge.

8 Claims, 3 Drawing Sheets

STORAGE BOX WITH LOCKING LID AND WALL MOUNTING APPARATUS

FIELD OF THE INVENTION

This invention relates to containers having lids and apparatus for mounting them on a wall, and more particularly to a box with a removable locking cover, and having a part used to attach the box to a wall mount.

BACKGROUND OF THE INVENTION

In the prior art there are many types of containers or boxes used to transport and/or store goods, and such containers or boxes are manufactured from many types of materials. Many of these boxes have lids that used to close the boxes so that their contents are securely contained inside. Such lids attach to the boxes in a manner that they are not easily removed to insure that the contents of the boxes remain securely therein even if the boxes are inverted or dropped.

In one such prior art box shown in U.S. Pat. Nos. 2,860,810 and 2,929,530 the lid has edges with grooves on the inside thereof that are parallel to the top of the lid. The grooves on the lid slide onto mating ridges on the side of and parallel to the top of the box. To insure that the top does not inadvertently slide off, the dimensions of the grooves and mating ridges are such that when the top is fully slid onto the box, there is an interference fit between the grooves and ridges that effectively locks the lid so as not to be easily removed from the box. Such interference fit lids have long been known in the box or container art as may be seen in storage jars with twist off caps. However, an interference fit arrangement sometimes makes it very difficult to thereafter remove the lid from the box or container.

It sometimes is useful to attach an inventory list or other information to the inside of a lid to a box so it may easily be determined what the contents of the storage box are, or what is to be done with the contents of the box. However, if the lid inadvertently becomes separated from the box the inventory list is not readily available to be used for its intended purpose. Thus, it would convenient to have the lid attached to the box in some manner. The previously identified U.S. Patents teach a storage box that has a lid that may be attached to the outside of the box but it is for the purpose of tipping the box up for display purposes. When in the tipped position the inside of the lid to the box is not readily seen so is no value for attaching an inventory list or other information to the inside of lid.

In some applications where a box is relatively small and is used for a purpose, such as carrying a set of eyeglass frames and lenses that are being ground to a prescription and then being inserted in the frames, there is a need to be able to store a relatively large number of the boxes in a small area for convenience. Merely stacking the boxes is not acceptable. To obtain a box on the bottom of a stack is a nuisance and may cause boxes on top of the desired box to fall. If conventional flat shelving is used, or pigeon hole shelving is used, they are sometimes unacceptable because they are relatively heavy, collect dust and thus cannot be used in clean room type environments. Also, when flat shelving is used other boxes may accidently be knocked off a shelf and damage the contents of the unwanted boxes.

Thus, there is a need in the art for a storage box having a lid that can retain the contents of the box therein when the box is inadvertently dropped or inverted.

There is also a need for such a storage box that can be locked to the box in a simple manner and in a way that it can always be easily removed.

In addition, there is a need for a mounting arrangement that permits the boxes to be stored in close proximity to each other in a way that permits each box to be easily obtained without disturbing other boxes, that prevents accidently knocking down boxes, and in a manner that will collect the least amount of dust.

SUMMARY OF THE INVENTION

The above needs of the prior art are satisfied by the present invention which provides a storage box that has a lid that is not readily accidentally removed from the box; that can lock to the box but is always easily removed; and that is attachable to a wall mounted storage apparatus that collects less dust than flat or pigeon hole shelving, that permits each box to be obtained without having to disturb other boxes, and that is fastened to the storage apparatus until specifically removed therefrom.

More particularly, the storage box of the present invention has two opposing edges on its open top side, each of which has an extension along most of its length that is parallel to the top of the box. The lid for the box has two opposing edges that are rolled under and the lid is attached to the box by sliding the rolled edges over and along the length of the extensions. This secures the lid to the box.

In addition, there is a flexible, flared extension that is colinear with each of the aforesaid extensions and that extends into a hole through each of the aforesaid extensions when the lid is fully slid along the length of the extensions when closing the box. When the flexible extensions extend into the holes through the rolled edges, the lid is locked to the box. To remove the lid from the box extra force is applied to the lid in a direction to slide it from the flexible extensions. The flexible extensions bend slightly to permit them to flex and exit the holes through the rolled edges, and the lid is then easily removed from the box.

There are also ridges or extensions on the rear of the box that are contiguous to the sides of the box. These ridges or extensions are spaced the same distance apart as the extensions on the edges of the top of the box that hold the lid to the top of the box. When the lid is removed from the box the rolled edges are slid down over these vertical ridges on the rear of the box, and thereby hold the lid to the box. When the lid is so held to the rear of the box it extends above the box and the under side of the cover that extends above the box may be seen. Any inventory list or other information attached to this visible portion of the under side of the lid is easily readable.

A simple wall mounting arrangement is provided for mounting a number of the boxes. For each box the mounting arrangement has two vertical rolled members that slide onto the vertical ridges on the rear of the box. There is also a small horizontal lip that extends perpendicular to the wall. When a box is attached to the wall mounting arrangement its bottom rear sits on the small horizontal lip while the vertical rolled members hold the vertical rolled ridges on the rear of the box.

DETAILED DESCRIPTION

Figure 1:
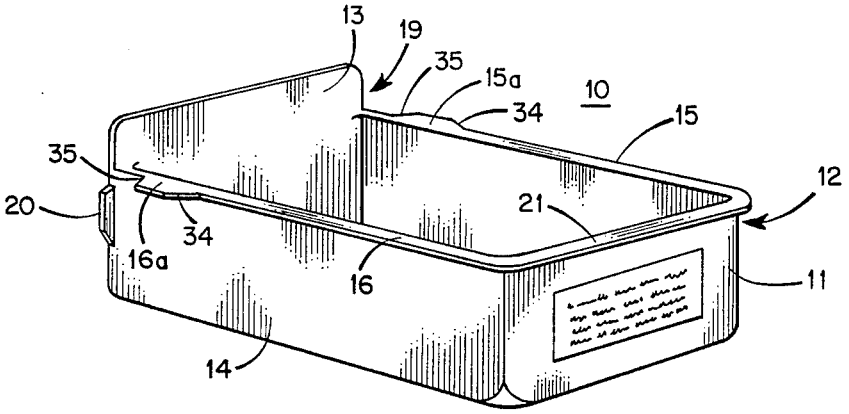
FIG. 1 is a front view of the storage box of the present invention.

In FIG. 1 is seen a front view of box 10 in accordance with the teaching of the invention. Box 10 may be of any length, width, and depth to meet the needs of any particular application; and may be fabricated of any one of a number of materials. In the preferred embodiment of the invention box 10 is molded of plastic.

Box 10 has a front side 11, a right side 12, a rear side 13 and a left side 14. The right top edges of box 10 has an extension 15 attached thereto with a short, flexible, flared extension 15*a*, and the left top edge of box 10 has an extension 16 attached thereto with a short, flexible, flared extension 16*a*. Only the narrow end of flexible extensions 15*a* and 16*a* are connected to their respective one of extensions 15 and 16 and the flared ends extending toward the rear of box 10 can flex. The wider portion of flexible extensions 15*a* and 16*a* have an edge 34 that faces toward the front of box 10, and an edge 35 that faces toward the rear of box 10.

Figure 4:
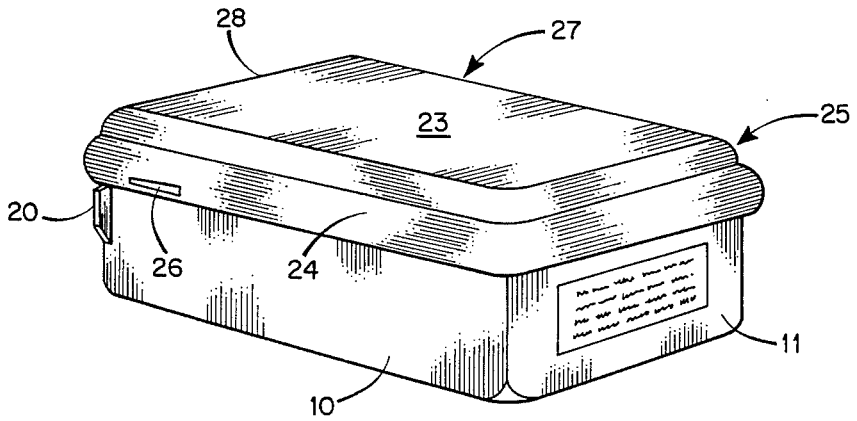
FIG. 4 is a front view of the lid closing the box.
Figure 6:
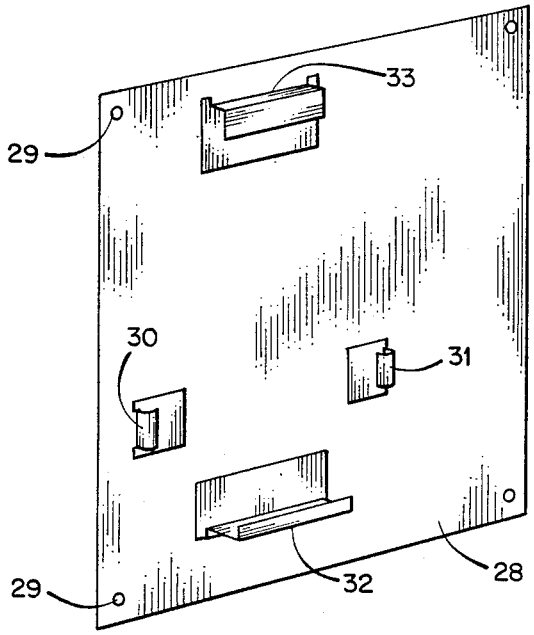
FIG. 6 is a view of a segment of a wall mounting apparatus for holding boxes, but with no boxes attached.

There is also a vertical ridge or extension 19 on the right rear corner of the box, and a vertical ridge or extension 20 on the left rear corner of the box as shown. Extensions 15 and 16 with their flexible extensions 15*a* and 16*a* are used to hold lid 23, shown in FIG. 2, to the top of box 10 as shown in FIG. 4 so as not come off inadvertently, and thereby securely hold the contents of box 10 therein. Ridges or extensions 19 and 20 are used to attach lid 23 upright on the rear of box 10 as shown in FIG. 6.

The inside of box 10 can have a number of vertical ridges molded on the inside walls of box 10, such as 21*a*, 21*b* and 22*a*, 22*b*, but only these ridges are shown for example. These ridges are used to create partitions inside of box 10 in a manner well known in the art. A flat piece of plastic (not shown) would be inserted vertically into box 10 so that one edge is between ridges 21*a* and 21*b*, and another edge is between ridges 22*a* and 22*b*, thus creating a partition.

Figure 2:
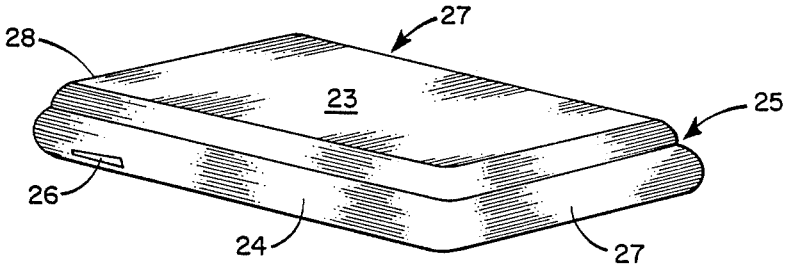
FIG. 2 is a front view of the security lid for the box of the present invention.

FIG. 2 is a front view of lid 23 in accordance with the teaching of the invention. Lid 23 may be fabricated of any one of a number of materials, but in the preferred embodiment of the invention lid 23 is molded of plastic. As may be seen the front, right and left edges of lid 23 each have downward extending portions. In this manner the contents of box 10 are protected from accidentally spilled liquids. The bottom edge of the left and right downward extending portions each have rolled under edges 24 and 25 as shown. Through the right side rolled edge 24 is an elongated hole 26, while through the left side rolled edge 25 is another elongated hole 27. Holes 26 and 27 cooperate with the flared ends of flexible extensions 15*a* and 16*a* when lid 23 is attached to box 10 to lock lid 23 to box 10. The lower side of the rear edge of lid 23 has a step along it that extends over the top of rear side 13 when the lid fully closes box 10. This also protects the interior of box 10 from accidentally spilled liquid.

Figure 3:
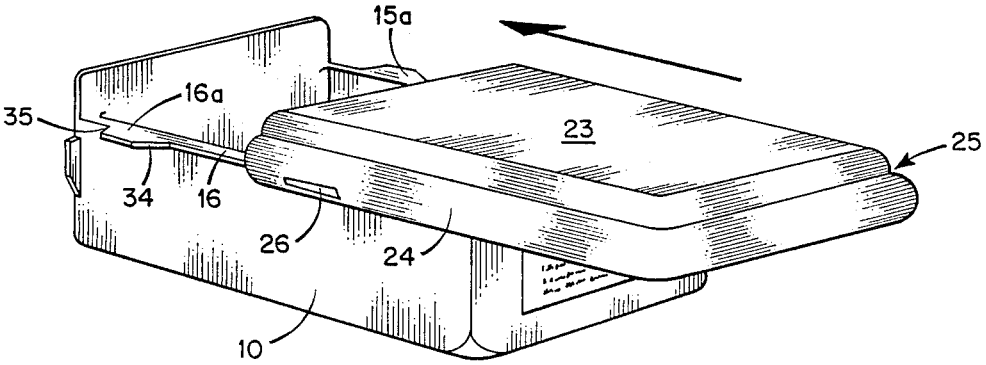
FIG. 3 is a front view of the lid as it is being attached to the box.

In FIG. 3 is shown a view of lid 23 being slid onto box 10 in the direction indicated by the arrow. The rolled edges 24 and 25 extend under extension 15 and 16 and slide along as lid 23 closes box 10. Because edges 24 and 25 extend under extensions 15 and 16, lid 23 is held to box 10 and can only be removed by sliding lid 23 in the direction opposite to the arrow.

In FIG. 4 is shown a view of lid 23 fully closing box 10. With reference to both FIGS. 1 and 2, to attach lid 23 to box 10, the rear end 28 of lid 23 is slid onto extensions 15 and 16 of box 10 starting from its front side 11. The left to right dimension between the insides of rolled edges 24 and 25 is equal to or slightly larger than the left to right dimension from the outer edges of extensions 15 and 16. Thus, when lid 23 is slid onto extensions 15 and 16 to close box 10, it can only be removed by sliding it in the opposite direction. It cannot be removed vertically.

The left to right outside dimension of flared extensions 17 and 18 is slightly larger than the left to right dimension between the insides of rolled edges 24 and 25. Thus, lid 23 can be easily slid onto box 10. As lid 23 is slid further onto extensions 15 and 16, it encounters the flared ends of flexible extensions 15*a* and 16*a*. To continue to slide lid 23 onto box 10 creates a stress that causes the flared ends of flexible extensions 15*a* and 16*a* to deform slightly inward and the rear edge of the two rolled edges of lid 23 rides up over edges 34 which are ramped with respect to lid 23. As holes 26 and 27 through rolled edges 24 and 25 come into registration with the inwardly flexed ends of flexible extensions 15*a* and 16*a* the stress in them is relieved and the flared ends extend into holes 26 and 27. This locks lid 23 to box 10 and prevents accidental removal of lid 23 from box 10.

To remove lid 23 from box 10 requires that finger nails or small objects be used to concurrently depress flexible extensions 15*a* and 16*a* until they no longer extend into holes 26 and 27. This must be done since the rear edges 35 of flexible extensions 15*a* and 16*a* are essentially vertical to the side walls of box 10. Lid 23 is then slid toward the front 11 of box 10. Flexible extensions are held flexed inwardly at this time and are under stress. This stress is removed when lid 23 moves about an inch and the flared ends of extensions 15 and 16 exit from within rolled edges 17 and 18 at the rear of lid 23.

Alternatively, rear edges 35 of flexible extensions 15*a* and 16*a* may also be ramped, as are front edges 34. To remove lid 23 from box 10 in the case force is applied to lid 23 in a direction to slide it toward the front side 11 of box 10. This removal force creates a stress that again inwardly flexes flexible extensions 15 and 16 since edges 35 are ramped. This stress is removed when lid 23 moves about an inch and the flared ends of extensions 15 and 16 exit from within rolled edges 17 and 18.

Figure 5:
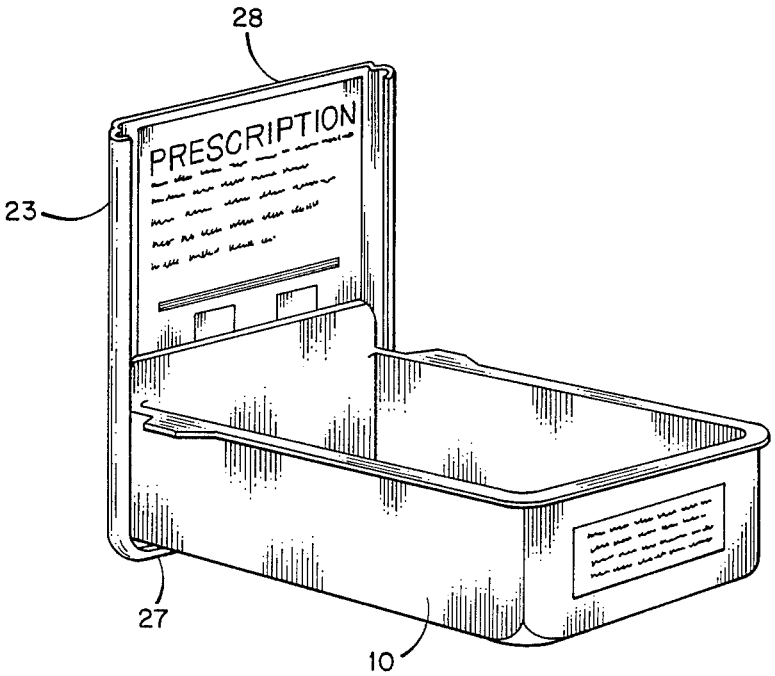
FIG. 5 is a front view of the box with the lid attached to the rear of the box.

In FIG. 5 is seen a front view of lid 23 attached to the rear of box 10. This is done for two purposes. First, it keeps lid 23 from being separated from box 10. This is important because, as may be seen in FIG. 5, an inventory list or other information on a piece of paper is attached to the underside of lid 23. When attached to the rear of box 10, lid 23 extends vertically above the top edge of box 10 so that the inventory list or other information may easily be seen. When box 10 is picked up and moved lid 23 remains attached to the rear of box 10 and is not inadvertently separated therefrom.

In the preferred embodiment of the invention the left to right dimension between the insides of rolled edges 24 and 25 is equal to or slightly less than the left to right dimension from the outer edges of vertical ridges 19 and 20. To attach lid 23 to the rear of box 10 its rear edge 28 is slid upward onto ridges 19 until the front edge of lid 23 hits the bottom of box 10. As lid 23 is slid upward over ridges 19 and 20 the difference in the dimensions creates a slight interference fit that holds lid 23 to the rear of box 10.

In an alternate embodiment of the invention the left to right dimension between the insides of rolled edges 24 and 25 is equal to or slightly larger than the left to right dimension from the outer edges of ridges 19 and 20. With this embodiment (not shown) there are also arctuate extensions on each of vertical ridges 19 and 23 and lid 23 locks onto them in the same or similar manner as it locks onto extensions 15 and 16.

Figure 7:
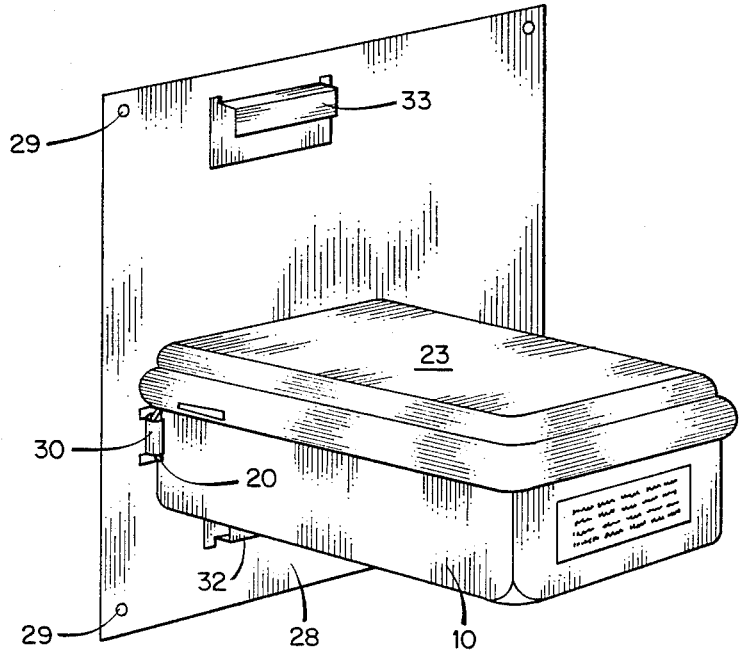
FIG. 7 is a view of the wall mounting apparatus with a box attached thereto.

In FIG. 6, is shown a portion of a wall mounting apparatus 28 that is used to hold a number of boxes 10 with lids 23 on a wall (not shown). Means for holding only one box 10 is shown in FIG. 6 for ease of representation. The wall mounting apparatus 28 may be as large as needed to hold any desired number of boxes. In the preferred embodiment of the invention apparatus is stamped out of a relatively thin sheet steel, as shown in FIG. 6, but may be made of many different materials. Mounting apparatus 28 has multiple holes therethrough, such as exemplary holes 29, that are used to screw or nail apparatus 29 to a wall. Apparatus 28 has opposed stamped pieces 30 and 31 that go around vertical extensions 19 and 20 on the rear corners of box 10 to hold box 10 to apparatus 28 as shown in FIG. 7. There are also stamped pieces 32 and 33. Piece 32 forms a ledge that supports the bottom of box 10 when it is attached to apparatus 28, and piece 33 is used when box 10 with open lid 23 (shown in FIG. 5) are attached to wall mounting apparatus 28.

Alternatively, apparatus 28 may be a pair of pieces (not shown) which are fastened by fastening means, such as screws or other fastening means that are well known in the art, to a wall (not shown) in a vertical orientation and at a specified spacing that allows box 10 to be attached to apparatus 28 via its vertical extensions 19 and 20 as shown in FIG. 6. The vertical mounting pieces have a plurality of opposed rolled edges below which are formed ledges that extend perpendicular to the wall on which mounting apparatus 28 is fastened.

FIG. 7 shows a box 10 with a lid 23 closing same attached to mounting apparatus 28. The bottom rear of box 10 sits on and is supported by piece 32 while vertical extensions 19 and 20 of box 10 are retained by pieces 30 and 31 of apparatus 28. To detach box 10 from mounting apparatus 28, box 10 is moved upwards until vertical extensions 19 and 20 are free from 30 and 31. Box 10 is then moved away from the wall.

While what is described herein is the preferred embodiment of the invention, one skilled in the art may modify same in many ways without departing from the spirit and scope of the invention. For example, the horizontal extensions 15 and 16 need not be connected to the top of left and right side walls 15 and 16, but may be located a little below the top of walls 15 and 16. With this configuration lid 23 would have vertical edges attached to its main flat surface, and the rolled edges 24 and 25 would be attached to the vertical edges. For another example, arctuate extensions 17 and 18 may each be pyramid shaped and its sloped sides will cause the rolled edges to be deformed as lid 23 is being slid onto box 10 to its locking position. In addition, ribs may be formed in walls of box 10 and on the top of lid 23 to increase structural strength in a manner well known in the art.

What is claimed is:

1. A storage container and mounting arrangement comprising:

a box having a pair of spaced side walls, a pair of spaced end walls, a bottom wall, and an open top, said box having first extensions projecting outwardly from the top edge of each of said side walls, said first extensions each having a second extension projecting outwardly therefrom with said second extensions being located near the rear end wall, and said second extensions each having sloped surfaces facing toward the front and rear end walls of said box;

a lid for said box, said lid having a top and bottom side, front, rear, and left and right side edges, said left and right side edges being rolled under toward the bottom side of said lid, said rolled edges each having a linear slot therethrough near the rear edge of said lid, the distance between the inside of said rolled edges being slightly greater than the distance between the outside edges of said first extensions, and said lid is attached to said box by sliding said rolled edges over and along said first extensions, as said lid is slid onto said first extensions the rolled edges contact the front sloped surfaces of said second extensions and are deformed slightly outward as said lid is slid further onto said first extensions of said box, and when said lid fully closes said box said second extensions enter said linear slots through said rolled edges to thereby lock said lid to said box and prevent accidental opening of the storage container while not preventing subsequent removal of said lid from said box, and said lid is unlocked and removed from said box by applying a force to said lid to slide it toward the front of said box, said force causing said rolled edges to deform slighly outward as they contact the rear sloped surface of said second extensions and said second extensions exit from said said linear slots.

2. The invention in accordance with claim 1 wherein said storage container further comprises third extensions attached to said box where each of said left and right side walls meet said rear end wall, the third extensions being used to attach said lid to the rear of said box after said lid is removed from the top of said box so that said lid is not separated from said box, the rolled edges of said lid being slid down over said third extensions to attach said lid to the rear of said box.

3. The invention in accordance with claim 2 wherein said lid of said storage container further comprises means on its bottom side for holding a piece of material on which is information regarding the contents of said box, said information being visible when said lid is attached to the rear of said box.

4. The invention in accordance with claim 3 further comprising:

mounting means for holding said storage container, said mounting means being fastenable to a vertical surface, said mounting means having pairs of opposed rolled edges and ledge means below said pairs of opposed rolled edges, said box being attached to said mounting means by sliding said third extensions of said box downward into said opposed rolled edges until the bottom wall of said box sits on said ledge means, and said storage container is detached from said mounting means by moving it upward until said third extensions are free of said opposed rolled edges.

5. A storage container comprising:

A box having a pair of spaced side walls, a pair of spaced end walls, a bottom wall, and an open top, said box having first extensions projecting outwardly from the top edge of each of said side walls, said first extensions each having a second extension projecting outwardly therefrom with said second extensions being located near the rear end wall;

a lid for said box, said lid having a top and bottom side, front, rear, and left and right side edges, said left and right side edges being rolled under toward the bottom side of said lid, said rolled edges having a hole therethrough near the rear edge of said lid, the distance between the inside of said rolled edge being slightly greater than the distance between the outside edges of said first extensions, and said lid is attached to said box by sliding said rolled edges over and along said first extensions; and as said lid is slid onto said first extensions the rolled edges hit said second extensions, said rolled edges are deformed outward as said lid is slid further onto said first extensions of said box, and when said lid fully closes said box said second extensions enter said holes through said rolled edges to thereby lock said lid to said box.

6. The invention in accordance with claim 5 wherein said storage container further comprises third extensions attached to said box were each of said left and right side walls meet said rear end wall, the third extensions being used to attach said lid to the rear of said box after said lid is removed from the top of said box so that said lid is not separated from said box, the rolled edges of said lid being slid down over said third extensions to attach said lid to the rear of said box.

7. The invention in accordance with claim 6 wherein said lid of said storage container further comprises means on its bottom side for holding a piece of material on which is information regarding the contents of said box, said information being visible when said lid is attached to the rear of said box.

8. A storage container and hanging apparatus comprising:

a box having a pair of spaced side walls, a pair of spaced front and rear end walls, a bottom wall, and an open top, said box having first extensions projecting outwardly from the top edge of each of said side walls, said first extensions each having a second extension projecting outwardly therefrom with said second extensions being located near the rear end wall, and said second extensions each having sloped surfaces facing toward the front and the rear end walls of said box;

a lid for said box, said lid having a top and bottom side, front, rear, and left and right side edges, said left and right side edges being rolled under toward the bottom side of said lid, said rolled edges each having a linear slot therethrough near the rear edge of said lid, the distance between the inside of said rolled edges being slightly greater than the distance between the outside edges of said first extensions, and said lid is attached to said box by sliding said rolled edges over and along said first extensions, and as said lid is slid onto said first extensions the rolled edges hit the front sloped surfaces of said second extensions and are deformed slightly outward as said lid is slid further onto said first extensions of said box, when said lid fully closes said box said second extensions enter said linear slots through said rolled edges to thereby lock said lid to said box and prevent accidental opening of the storage container while not hindering subsequent removal of said lid from said box, and said lid is completely removed from said box by applying force to said lid to slide it toward the front of said box, said force causing said rolled edges to deform slightly outwards as they contact the rear sloped surface of said second extensions;

third extensions attached to said box where each of said left and right side walls meet said rear end wall, said third extensions being substantially vertical and being used to attach said lid to the rear of said box after said lid is completely removed from the top of said box so that said lid is not separated from said box, the rolled edges of said lid being slid down over said third extensions to temporarily attach said lid to the rear of said box and thereby prevent it from being separated from said box; and mounting means for holding said storage container, said mounting means being fastenable to an upright surface, said mounting means having a pair of opposed turned edges and a ledge means below said pairs of opposed turned edges, said box being attached to said mounting means by sliding said third extensions of said box downward between said opposed turned edges until the bottom wall of said box sits on said ledge means, and said storage container is detached from said mounting means by moving it upward until said third extensions are free of said opposed turned edges.

* * * * *